United States Patent [19]

Kidd

[11] 4,247,746

[45] Jan. 27, 1981

[54] ELECTRIC CIRCUIT BREAKER

[75] Inventor: Alan L. Kidd, Southport, England

[73] Assignee: Dorman Smith Switchgear Limited, Preston, England

[21] Appl. No.: 34,441

[22] Filed: Apr. 30, 1979

[51] Int. Cl.[3] ..... H01N 33/10

[52] U.S. Cl. ..... 200/147 R; 200/144 R

[58] Field of Search ..... 200/147 R, 144 R, 147 A

[56] References Cited

U.S. PATENT DOCUMENTS

| | | | |
|---|---|---|---|
| 2,372,045 | 3/1945 | Armstrong | 200/147 R |
| 2,626,331 | 1/1953 | Basnett | 200/147 R |
| 3,071,666 | 1/1963 | Ellsworth et al. | 200/147 R |

*Primary Examiner*—Robert S. Macon

*Attorney, Agent, or Firm*—Ross, Ross & Flavin

[57] ABSTRACT

In the or each pole of an electric circuit breaker, the or each moving contact arm is mounted. by a pivot pin, upon a carrier, in such a manner as to permit lost motion between the arm and the carrier, the arm being spring-loaded towards an operative position wherein a moving contact carried by the arm engages with a fixed contact. A tripping mechanism serves, upon passage of an overload slightly in excess of the rated current, or upon short circuit, to rotate the carrier so as to lift the movable contact away from the fixed contact. Arc-quenching plates are so slotted, each with a respective key-hole shaped slot, and are so positioned that electromagnetic forces, set up upon short-circuit, tend to blow back the moving contact arm, to separate the contact from the fixed contact, thereby initiating circuit interruption even before the actual tripping mechanism has started to initiate contact opening. To ensure optimum blow-back effect, the arms of the quenching plates extend towards the pivot pin by a distance which is from 30% to 70% of the entire distance between the movable contact and the pivot pin.

9 Claims, 2 Drawing Figures

ELECTRIC CIRCUIT BREAKER

BACKGROUND OF THE INVENTION

This invention concerns electrical circuit breakers of the kind comprising, for the or each pole thereof, a fixed contact, a movable contact arm carrying a movable contact and swingable between an 'on' position in which the movable contact engages with the fixed contact, and an 'off' position in which the movable contact is separated from the fixed contact, the circuit breaker further including a tripping mechanism which serves, upon passage through the circuit breaker of current in excess of the rated current of the breaker, to cause the movable contact arm or arms to swing into the 'off' position.

The invention is more particularly concerned with circuit breakers of this kind (hereinafter called "of the kind described") in which the movable contact arm is spring loaded towards the fixed contact so as to be capable of limited movement against the action of the spring and away from the fixed contact independently of the tripping mechanism, such as arrangement permitting the movable contact arm to move or be "blown back" under the influence of the very substantial electromagnetic forces which arise in the event of passage of short circuit current, so that contact opening movement of the movable contact arm is initiated upon the occurrence of a short circuit even before operation of the tripping mechanism. This spring-loading of the moving contact arm, permitting a limited amount of independent movement of the arm under the electromagnetic blow-back forces arising on passage of short-circuit currents, contributes to protecting the components of the circuit controlled by the circuit breaker by restricting the length of time during which any short circuit current may pass therethrough.

It is well known, in electrical circuit breakers, to provide, adjacent the movable contact arm, a series of so-called "arc-quenching plates", these each being of V-shaped configuration and arranged approximately in an arcuate array so that the swinging movement of the movable contact arm causes the movable contact to move through the successive recesses defined by the limbs of the successive arc-quenching plates.

As hitherto proposed, the shapes and dimensions of such arc-quenching plates have generally been such that each said plate defines a generally V-shaped recess for passage therethrough of just the free end of the movable contact arm and the movable contact carried thereby. Thus, as a general rule, the arc plates in the prior known constructions have not contributed significantly to the generation of blow-back forces upon the occurrence of a short-circuit.

The present invention is based upon the appreciation that said arc-quenching plates can be utilised to improve the blow back forces occurring upon passage of short circuit currents, thereby to assure a more rapid contact separation, with consequential improved protection for the circuit breaker and the circuit controlled thereby.

BRIEF STATEMENT OF INVENTION

The present invention provides an electric circuit breaker of the kind described comprising, for the or each movable contact arm, an array of arc-quenching plates of magnetic material, each of which arc-quenching plates is generally of U-shaped configuration providing an air gap between the limbs of the U for the respective moving contact arm to move therethrough, characterised in that each said arc-quenching plate has its limbs so dimensioned as to extend past the respective movable contact carried at the free end of the respective movable contact arm to a respective termination the position of which is spaced away from the movable contact by a distance which is not less than 30% of the spacing between the swinging axis of the movable contact arm and the movable contact, and is not greater than 70% of said spacing, and in that the gap in each said arc-quenching plate is shaped to have one enlarged inner end, wider than the mouth of the gap where the latter meets the edge of the plate.

Generally speaking, little or no benefit is achieved from extending the arc-quenching plate limbs too close to the said swinging axis of the movable contact arm, and this is why the terminations of the said limbs need not extend past the movable contact by a distance in excess of about 70% of said spacing.

In practice, of course, the lengths of the limbs of each arc-quenching plate may be dependent upon various practical factors, such as the proximity of other components, ease of assembly, and available space, so that the position at which each limb terminates may vary according to the individual design of the circuit breaker. Thus, within the scope of the invention, the limbs of each arc-quenching plate might extend past the movable contact to an extent that the distances between their terminations and the swinging axis is 40%, 50% or 60% of the said spacing between the movable contact and the swinging axis, but proportions differing from these may arise.

We believe, however, that optimally the said portion should be such that the ends of the limbs of the arc-quenching plates project slightly past halfway between the movable contact and the swinging axis, so that the said distance of the terminations and the swinging axis should preferably be from 45% to 50% of the said spacing.

The shape and extent of the gap between the limbs of each arc-quenching plate is, of course, significant in relation to the blow-back effect achieved by the plate, and in theory this gap should be kept as small as practicable, whilst leaving adequate clearance for the moving contact arm to pass therethrough. Accordingly, the said gap may be shaped complementarily to the profile of the movable contact arm and the movable contact carried thereby. Said arm and contact are advantageously narrow, and of substantially equal widths, so that the gap in the arc-quenching plate may be correspondingly substantially parallel-sided.

We have found in practice, however, that an appreciable improvement in the overall function is obtained by the removal of the arc chute plate material from the region of the plate through which the movable contact, carried by the movable contact, carried by the movable contact arm, passes, thus reducing the amount of metal vapor present within the circuit breaker during an interruption. This removal of the plate material determines the shape of the gap in the arrangement of the invention, the gap being shaped, as stated, to have an enlarged inner end, wider than the mouth of the gap where the latter meets the edge of the plate.

The gap is advantageously, substantially key-hole shaped having a relatively narrow neck portion which connects with the said edge of the plate and a relatively enlarged inner circular portion. The enlarged inner circular portion is preferably centered on a point at which the moving contact engages the respective fixed contact and of a radius of not less than 15% of the distance between said point and the swinging axis of the movable contact arm, or the width of the contact arm itself, whichever is the greater.

BRIEF DESCRIPTION OF THE DRAWINGS

The invention will be described further, by way of example, with reference to the accompanying drawing which illustrates a practical embodiment thereof, it being understood that the following description is illustrative, and not restrictive, of the scope of the invention. In the drawing.

DESCRIPTION OF THE ILLUSTRATED EMBODIMENT

Figures 1, 2:
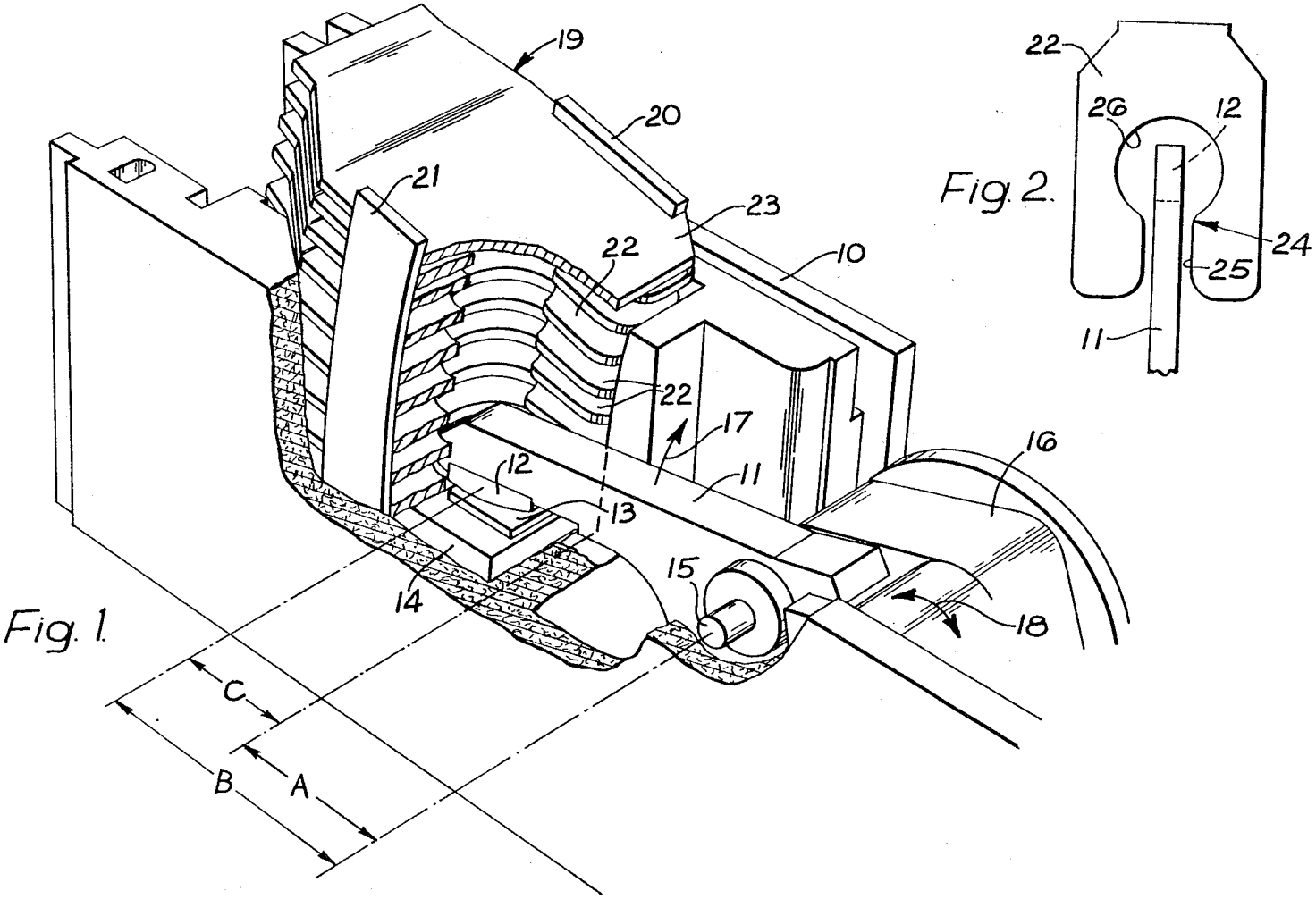
FIG. 1 is a fragmentary perspective view, with parts cut away, illustrating only those parts of the preferred embodiment of the circuit breaker necessary to enable the invention to be understood.
FIG. 2 is a detached plan illustrating one of the arc-quenching plates of the arrangement of FIG. 1.

The illustrated preferred embodiment of the electric circuit breaker of the invention is a molded-case circuit breaker and comprises a generally rectangular molded plastics casing composed of a base 10 and a removable cover (not shown) which together define a generally rectangular interior space housing the operative components of the circuit breaker. These comprise, from one end of the casing, a first terminal (not visible) accessible from outside the casing to enable an electric lead (not shown) to be connected thereto, a first conductor strip (not shown) extending therefrom to a flexible braid (not shown) connected to a movable contact arm 11 carrying a movable contact 12 which, in the 'on' condition of the circuit breaker, is pressed against a fixed contact 13 provided on a second conductor strip 14 extending to a second terminal (not shown). The first conductory strip is connected to the movable contact arm 11 by way of a thermally-responsive member (not shown) in the form of a bimetal strip adapted to be heated by current passing through the first conductor strip, and by way of an electromagnetic tripping arrangement (not shown) including an armature adapted upon passage of a very high current, such as a short circuit current, through the first conductor strip, to be displaced from a rest position. Both the bimetal strip and the armature are so associated with a pivoted trip bar (not shown) that in the event of (a) the passage of a sustained overload through the first conductor strip to cause heating of and deflection of the bimetal strip, and/or (b) upon displacement of the armature as a result of passage of short circuit current, the trip bar is pivoted from a basic stable rest position.

The movable contact arm 11 is pivotally mounted by one end upon a pivot 15 in a carrier member 16, and carries on its other end the movable contact 12 which faces the fixed contact 13 secured to the second conductor strip 14 which in turn is connected to the second terminal of the circuit breaker. This movable contact arm 11 is in the form of a relatively narrow bar of a relatively-good conducting material such as copper or aluminium, and is loaded by a spring (not visible) within the carrier member, so as to tend to swing, about its pivot 15 connecting it to the carrier member 16, towards its operative position engaging with the fixed contact 14, the action of this spring having a dead center position so that in the event of pivoting of the contact arm 11 in a direction away from the fixed contact 13 (i.e. in the direction of the arrow 17 in the drawing), it will, once it has passed the dead center position, be loaded by the spring towards an inoperative position moved away from the fixed contact 13.

The carrier member 16 itself is pivotable, as indicated by the double arrow 18, so as to enable the moving contact arm 11, when in its illustrated operative position relative to the carrier member 16, by movement of the carrier member 16, to be moved so as to bring the movable contact 13 or to separate the movable contact 12 from the first contact 13.

A pivoted dolly (not shown), projecting through the cover of the casing of the circuit breaker, enables the carrier member 16 to be moved in this way manually, the dolly being connected, by an actuating spring (not shown), to the center pivot of a pair of toggle links (not shown) which form a toggle of which one end is connected to the carrier member 16 and the other end of which is connected to a latch arm (not shown) which is engaged and held in an operative position by a protrusion projecting from the trip bar already referred to above. Whilst the latch arm is held in this operative position, the toggle can be straightened (to move the movable contact arm 11 to bring the movable contact 12 into engagement with the fixed contact 13 and thereby to close the circuit through the circuit breaker between its two terminals) and collapsed (to separate the movable contact 12 from the fixed contact 13 and thereby break the circuit), manually, by movement of the dolly. In the event of movement of the trip bar by the electromagnetic armature (upon passage of short circuit current) or by the bimetal strip (upon passage of a sustained overload) the latch arm is released by the trip bar, as a result of which the spring connecting the dolly to the toggle causes collapse of the latter to a tripped configuration and separation of the movable contact 12 from the fixed contact 13, the dolly correspondingly taking up an intermediate tripped position.

Resetting the circuit breaker to 'on' is effected by firstly moving the dolly fully to the off position thereby to cause a thrust surface integral with support arms of the dolly to engage the latch arm and move it back into engagement with the protrusion projecting from the trip bar. Of course, if the trip bar should still be in a pivoted or tripped condition, resetting cannot be effected, since the protrusion will not retain the latch arm.

Once the latch arm has been re-engaged with the protrusion, the dolly is swung to the 'on' position which causes straightening of the toggle and consequential swinging of the movable contact arm 11 to bring the movable contact 12 into engagement with the fixed contact 13.

All of the foregoing is, of course, comparable with established circuit breaker techniques.

Accommodated between the side walls of the base of the circuit breaker in the vicinity of the arc of movement of the movable contact arm 11 when the latter swings between its "off" and its "on" positions is a unit, indicated generally by the numeral 19, comprising a pair of side locators 20, 21 between which are secured a plurality of arc-quenching plates 22, of a magnetic material such as steel, and a top plate 23, the arc-quenching plates 22 being approximately equi-angularly spaced within the unit and each being disposed so as to be approximately radial of the axis provided by the pivot 15. One of these arc-quenching plates 22 is illustrated in FIG. 2.

Arc-quenching plates are, of course, already known and, as hitherto propounded, they usually each comprise a plate of approximately rectangular overall configuration with a V-shaped notch or recess formed in one end thereof; this notch or recess being of dimensions such as to enable passage therethrough of just the free end part of the respective movable contact arm, having the movable contact thereon.

In contrast to the prior known arc-quenching plates, as shown more particularly in FIG. 2, the arc-quenching plates 22 in the present embodiment, although generally of rectangular configuration, are each formed with a respective key-hole shaped gap or slot 24 therein, this comprising a relatively narrow neck portion 25 opening by a relatively narrow mouth to the edge of the plate 22 at one end and connecting with a relatively enlarged inner circular portion 26 at the other end. The dimensions of each said plate are such that each plate 22 projects past the free end of the pivoted movable contact arm 11 and the movable contact 12 by a distance (indicated at C in the drawing) which is approximately equal to one half of the spacing B between the contact point of the movable contact 12 against the fixed contact 13, and the swinging axis of the movable contact arm 11. The limbs of these arc-quenching plates 22 extend alongside the movable contact arm 11, over about half of the length of the movable contact arm 11 from its free end, and because of the positions thereof, such plates 22 contribute significantly to the propagation of electromagnetic blow-back forces upon passage of short circuit current through the movable contact arm 11.

The effect of said blow-back forces is enhanced by the presence in each plate 22 of the enlarged inner circular portion 26 of the gap or short 24, in the vicinity of the free end of the movable contact arm 11. In each arc-quenching plate 28, this portion 26 is centered on a position at which the moving contact engages the respective fixed contact and preferably has a radius of not less than 15% of the distance between said point and the swinging axis of the arm 11, or the width of the contact arm 11 itself.

The blow-back force arises from interaction between the magnetic field due to the current in the conductor as augmented by the presence of the steel arc quenching plate, and the current itself, as may be better understood from the following.

Considering a straight isolated conductor close to a U-shaped piece of magnetic material, the conductor's own field will be increased in the vicinity of the U-shaped material, since this replaces the normal magnetic path through air by a path having a very much lower reluctance. The effect of this is to produce a force on the conductor, tending to draw it into the space between the limbs of the U. This effect is more pronounced with a U shape, but in fact a conductor would be drawn towards any piece of magnetic material in its vicinity, even if the magnetic material is straight and flat, provided some portion of the conductor's normal magnetic field pattern is replaced by such material. In the arrangement of the invention, the augmented field is not only present between the limbs of the U-shaped arc-quenching plates, but is also evident some little distance outside the open end. Thus the effect of the longer arc-quenching plates in the arrangement of the invention will extend past their physical limits towards the contact arm pivot and produce a "blow-back" force along most of the length of the movable contact arm 11 by interaction with its own current.

The effectiveness of each element of this "blow-back" force naturally becomes less the nearer it gets to the pivot point, since the product of force times distance to the pivot reduces. There is, thus, not a great deal of benefit in extending the arc-quenching plates to very close to the pivot since, not only is their effect less, but they tend to become too close together and difficult to accommodate.

In practical use of the circuit breaker, upon passage of short circuit current, these electromagnetic blow-back forces serve to blow the movable contact arm 11 towards its inoperative position, causing swinging thereof on the pivot 15 by which it is connected to the carrier member 16 and corresponding separation of the movable contact 12 from the fixed contact 13 and interruption of the circuit through the circuit breaker. This occurs, of course, immediately upon occurrence of the short circuit, and accordingly circuit interruption occurs even before the trip mechanism (operation of which is initiated, of course, by the electromagnetic armature pivoting the trip bar, as already described above) has had time to release the latch arm and cause collapse of the toggle and corresponding movement of the carrier member 16. Accordingly, the arrangement of the invention serves to ensure very rapid contact separation and circuit interruption, thereby efficiently protecting the circuit into which the breaker is connected and also protecting the components of the breaker itself against possible damage by reason of prolonged passage of very high current therethrough.

Naturally the invention is not confined to the precise details of the foregoing example, and variations may be made thereto. Thus, for instance, in the described case, the length of the limbs of the arc-quenching plates 22 is such that their terminations are spaced away from the pivot axis 15 by a distance C which is about 50% of the distance B between the movable contact and the pivot axis; however, this spacing may be greater than or less than 50% of such distance, depending, for instance, upon practical considerations, and a range from 30% to 70% is thought to be of practical utility. Thus, in the illustrated case either A/B or C/B should be from 0.3 to 0.7. Naturally, the gap in each arc-quenching plate 22 should preferably be shaped to correspond with the profile of that part of the moving contact arm 11 which passes through the gap upon contact-opening and contact-closing movement of the arm 11 and the dimensions should preferably be such as to provide a clearance, with the arm 11, of the order of 2 mm to 5 mm at each side of the arm 11, but of course, this again is subject to practical circumstances.

Although the invention has been described only in relation to a single pole breaker, it will readily be understood that it can be applied, for example, to three-pole breakers.

I claim:

1. An electric circuit breaker comprising, for each current-conducting pole thereof, a fixed contact, a movable contact arm carrying said movable contact and swingable about a swinging axis between an "on" position, in which said movable contact engages with said fixed contact, and an "off" position in which said movable contact is separated from said fixed contact, said movable arm being adapted to perform tripping movement from said "on" position to said "off" position upon passage through said pole of current in excess of the rated current of said breaker, and said movable arm also being spring-loaded towards said fixed contact so as to be capable of limited movement independently of said tripping movement, and an array of arc-quenching plates each generally of U-shaped configuration providing a respective air gap between the limbs of the U for said moving contact arm to move therethrough, characterised in that each said arc-quenching plate has its limbs so dimensioned as to extend past said movable contact carried at the free end of said movable contact arm to a termination the position of which is spaced away from said movable contact by a distance which is not less than 30% of the spacing between said swinging axis of said movable contact arm and said movable contact, and is not greater than 70% of said spacing, and in that said gap in each said arc-quenching plate is shaped to have an enlarged inner end, wider than the mouth of said gap where the latter meets the edge of said plate.

2. An electric circuit breaker as set forth in claim 1 wherein said gap is substantially key-hole shaped, having a relatively narrow neck portion which connects with said edge of the plate and a relatively enlarged inner circular portion.

3. An electric circuit breaker as set forth in claim 2 wherein said inner circular portion is centered on a point at which said moving contact engages said fixed contact and is of a radius of not less than 15% of the distance between said point and said swinging axis of said movable contact arm.

4. An electric circuit breaker as set forth in claim 2 wherein said inner circular portion is centered on a point at which said moving contact engages said fixed contact and is of a radius not less than 15% of the width of said contact arm.

5. A circuit breaker as set forth in claim 1 wherein said termination of said limbs of said arc-quenching plates project slightly past halfway between said movable contact and said swinging axis.

6. A circuit breaker as set forth in claim 1 wherein said air gap is shaped complementarily to the profile of said moving contact arm and said moving contact carried thereby, to leave as small as possible clearance for said contact arm to pass therethrough.

7. A circuit breaker as set forth in claim 1 wherein said arc-quenching plates are connected together as a unit.

8. A circuit breaker as claimed in claim 7 wherein said plates extend between and are connected to side locators which form said array into its unit.

9. A circuit breaker as claimed in claim 8 wherein said unit has a top plate which is similar in external shape to said arc-quenching plates, but has no gap therein.

* * * * *